US005782363A

United States Patent [19]

Kirchen

[11] Patent Number: 5,782,363

[45] Date of Patent: Jul. 21, 1998

[54] METHOD OF CONDUCTING FLUIDIZED-BED FIRING WITH OPEN-PASS ASH OBTAINED FROM A COAL-FIRING PLANT OR THE LIKE

[75] Inventor: Günther Kirchen, Wurselen, Germany

[73] Assignees: SICOWA Verfahrenstechnik fur . . . Co. KG, Aachen; ProMineral Gesellschaft zur . . . mbH, Bergheim, both of Germany

[21] Appl. No.: 733,701

[22] Filed: Oct. 17, 1996

[30] Foreign Application Priority Data

Oct. 18, 1995 [DE] Germany ..... 195 38 711.2

[51] Int. Cl.[6] ..... B03B 9/00

[52] U.S. Cl. ..... 209/2; 209/352; 110/165 R

[58] Field of Search ..... 209/2, 352; 110/165 R

[56] References Cited

U.S. PATENT DOCUMENTS 4,279,222 7/1981 Pearce ..... 110/165 R X
4,969,404 11/1990 Virr ..... 110/165 R

FOREIGN PATENT DOCUMENTS

3400979 A1 7/1985 Germany .
3925279 A1 5/1990 Germany .

OTHER PUBLICATIONS

"Wirbelschicht–systeme 1990", VGB Technische Vereinigung der Grosskraftwerksbetreiber E.V., pp. 1–13.

*Primary Examiner*—David H. Bollinger
*Attorney, Agent, or Firm*—Cushman Darby & Cushman IP Group of Pillsbury Madison & Sutro, LLP

[57] ABSTRACT

The invention relates to the use of open-pass ash from coal-fired plants as bed sand in fluidized-bed firing.

10 Claims, 1 Drawing Sheet

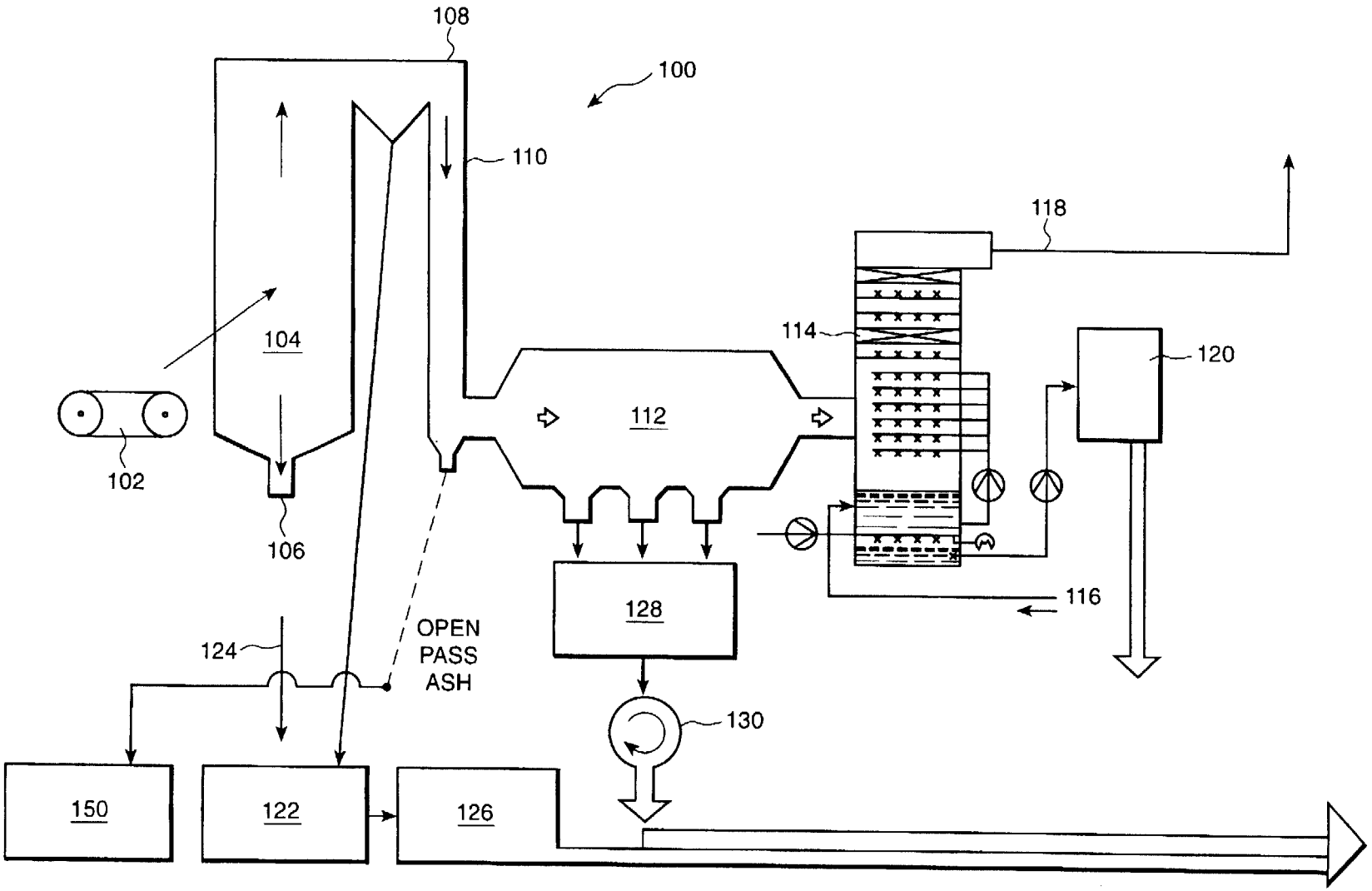
100
102
104
106
108
110
112
114
116
118
120
122
124
126
128
130
150
OPEN
PASS
ASH

METHOD OF CONDUCTING FLUIDIZED-BED FIRING WITH OPEN-PASS ASH OBTAINED FROM A COAL-FIRING PLANT OR THE LIKE

BACKGROUND OF THE INVENTION

1. Field of the Invention

The invention relates to a fluidized bed firing process which makes use of open-pass ash derived from coal-firing plants.

2. Description of the Related Art

In general, coal-firing or lignite-firing power station boilers are designed in such a way that, in the radiation part (e.g., combustion chamber), relatively coarse non-combustible constituents, together with unburnt particles of coal or coke, are intercepted as so-called wet ash or boiler sand in a water bath located underneath the radiation part, whilst a flue gas is conducted via contact heating surfaces, so as to emit further heat, to electrostatic or cloth filters, where the fine dust is separated as so-called filter ash.

Relatively coarse-grained ashes occur in the boiler parts and flue-gas conduits which are arranged between the combustion chamber and the filter. These parts and conduits include, for example, cross passages, open passages, second and third passages, air preheating passages. The ashes conveyed through these passages are hereafter referred to as a whole as open-pass ash. These ashes are conducted via conveying conduits, for cooling, into the water bath, which is intended for the wet ash and is located underneath the combustion chamber, or into the conveying assemblies for the wet ash.

As disclosed, for example, in EP 0 615 518 B1, it is known to treat filter ashes for specific purposes. However, the wet ash, on account of its water content, presents some problems and can therefore be reused only to a limited extent, especially since the grain size is relatively large and fluctuates very sharply.

SUMMARY OF THE INVENTION

It is therefore an object of the invention to provide an expedient practical use for open-pass ash obtained from a coal-firing or lignite-firing plant, which ash has hitherto been processed as wet ash in coal-firing power stations, without treatment which involves a high outlay.

This object is achieved by practicing a method comprising the steps of separating open-pass ash from at least one coal-firing plant, conveying the open-pass ash to a fluidized bed for fluidized-bed firing, and introducing the open-pass ash into the fluidized bed as bed sand.

This and other objects, features, and advantages of the present invention will become apparent from the following detailed description when taken in conjunction with the accompanying drawing which illustrates, by way of example, the principles of the present invention.

BRIEF DESCRIPTION OF THE DRAWING

The accompanying FIGURE schematically shows a coal-firing power plant adapted to permit the interception of a portion of an open-pass ash for use in a fluidized-bed firing operation.

DETAILED DESCRIPTION OF THE INVENTION

The FIGURE illustrates an example of a coal-firing power station, generally designated by reference numeral 100, from which open-pass ash suitable for use in the present invention can be obtained. In the station 100, coal is introduced from a feeder 102 into a combustion chamber 104, which is operated at a temperature sufficient to produce ash. For example, the combustion chamber 104 can operate at about 1100° C. From the combustion chamber 104, a portion of the ash is discharged via conduit 106, while the remaining portion is passed through cross passage 108 and open passage 110 to a pre-intermediate post cleaning apparatus 112. The ash is then passed to a droplet separator 114, which receives a limestone suspension through conduit 116 and discharges a purified gas through conduit 118. Finally, a gypsum 120 is provided downstream from the droplet separator 114.

In the illustrated station 100, a portion of the ash passing through the cross passage 108 can be removed and passed to a water container 122, where the ash can be combined with boiler ash fed from conduit 124 before being passed to a wet ash bunker 126. Another portion of the ash can be removed from the cleaning apparatus 112 and conveyed to a fly ash bunker 128, and thereafter conveyed to a mixer 130 where the ash is mixed with water. The wet ash discharged from the wet ash bunker 126 and mixer 130 can then be combined for further processing.

Contrary to the above-described conventional method of conducting of the open-pass ash into the water bath for obtaining wet ash or into the conveying conduits for wet ash, which has been practiced for many decades, according to the invention the open-pass ash is intercepted when it is dry, i.e., before it is made into wet ash. For example and without limitation, as shown in the FIGURE, the open-pass ash is intercepted between the open passage 110 and the water container 122, and is conveyed in dry form to a fluidized bed station 150. If desirable, open-pass ashes can be intercepted from a plurality of power station units and can be combined by guiding the respective downpipes to a collecting silo.

The open-pass ash has a grain-size distribution which ranges from virtually zero up to about 1 mm, but by far the greatest proportion of mineral constituents (generally more than 90%) of the open-pass ash has a grain size in the range between about 100 μm and 500 μm. With respect to the chemical composition of open-pass ash, there is very little fluctuation in open-pass ash. The open-pass ash can first be subjected to magnetic separation if ferriferous constituents are present and may cause problems.

The present inventor has discovered that the particle size and composition of the open-pass ash obtained from conventional coal-firing or lignite-firing power plants makes the open-pass ash particular suitable for use as bed sand in a fluidized-bed firing operation. The bed sand required for fluidized-bed firing is a sand with a grain size between 100 μm and 300 μm which, since appropriate wet grinding and drying are necessary, is correspondingly expensive when it is produced from natural sand. In view of the grain-size distribution occurring in open-pass ash (generally about 70% in the range of 100 μm to 300 μm), it is preferable to use the open-pass ash as bed sand. Specifically, in the state in which the open-pass ash is intercepted from a coal-firing or lignite-firing power plant, the small grain fraction having a size of less than 100 μm is discharged into the fly ash, whilst the likewise relatively small grain fraction having a size of greater than 300 μm is drawn off together with other coarse grain.

The fraction of coke particles can at the same time be used as fuel in the fluidized bed, unless the coke particles are to be used as activated coke or otherwise as fuel, in which case the coke particles can, for example, be separated off beforehand by screen separation with a maximum particle size allowed to screen through being about 500 μm or by pulsed-air vibration sorting. Sifting can also be carried out in such a way that a grain range of up to about 250 μm to 300 μm is separated off and is used as bed sand. The coarser grain fraction and the coke particles are thereby removed.

In this case, a combination of screening and sifting may likewise be expedient in order, on the one hand, to produce bed sand with the desired fine granulation of up to about 250 μm to 300 μm and, on the other hand, to produce fuel of a coarser granulation which can be used in the same connection. The fuel thus obtained can be metered separately.

One advantage of the present invention is that the open-pass ash is typically subjected to high temperature treatment during combustion in the coal-firing or lignite-firing power station. Consequently, the open-pass ash employed in connection with the present invention contains a silica sand fraction that is rounded, such that the silica sand fraction of the open-pass ash is less abrasive than fine sand from a natural deposits.

To produce a bed sand for fluidized-bed firing systems which exactly meets the requirements demanded in such systems, the open-pass ash can also be sifted at about 300 μm, as mentioned above, whilst the fraction thereby obtained, containing fine sand of about 300 μm to 1000 μm and carbon particles, can be, if appropriate, separated additionally into mineral and carbon particles and can be used, as described above. The relatively coarse fine sand obtained here can, if appropriate, be used in another way.

I claim:

1. A method of conducting fluidized-bed firing with open-pass ash obtained from a coal-firing plant or the like, said method comprising the steps of:

separating open-pass ash from at least one coal-firing plant or lignite-firing plant and conveying the separated open-pass ash to a fluidized bed of a fluidized-bed firing system; and introducing the separated open-pass ash into the fluidized bed as bed sand.

2. A method according to claim 1, wherein the open-pass ash is dry when separated from the coal-fired plant.

3. A method according to claim 2, further comprising burning combustible constituents of the open-pass ash as additional fuel in the fluidized-bed.

4. A method according to claim 2, further comprising separating off a portion of the open-pass ash having a grain size of greater than about 500 μm by screening, sifting, or screening and sifting.

5. A method according to claim 2, further comprising separating off a portion of the open-pass ash having a grain size outside of a range of about 250 μm to about 300 μm by screening, sifting, or screening and sifting.

6. A method according to claim 1, further comprising burning combustible constituents of the open-pass ash as additional fuel in the fluidized-bed.

7. A method according to claim 6, further comprising separating off a portion of the open-pass ash having a grain size of greater than about 500 μm by screening, sifting, or screening and sifting.

8. A method according to claim 6, further comprising separating off a portion of the open-pass ash having a grain size outside of a range of about 250 μm to about 300 μm by screening, sifting, or screening and sifting.

9. A method according to claim 1, further comprising separating off a portion of the open-pass ash having a grain size of greater than about 500 μm by screening, sifting, or screening and sifting.

10. A method according to claim 1, further comprising separating off a portion of the open-pass ash having a grain size outside of a range of about 250 μm to about 300 μm by screening, sifting, or screening and sifting.

* * * * *